US005321172A

United States Patent [19]

Alexander et al.

[11] Patent Number: 5,321,172

[45] Date of Patent: Jun. 14, 1994

[54] LUBRICATING COMPOSITION FOR TWO-CYCLE INTERNAL COMBUSTION ENGINES

[75] Inventors: A. Gordon Alexander; Alan G. Blahey, both of Sarnia, Canada

[73] Assignee: Exxon Research and Engineering Company, Florham Park, N.J.

[21] Appl. No.: 23,289

[22] Filed: Feb. 26, 1993

[51] Int. Cl.[5] ..... C10M 129/74; C10M 137/04

[52] U.S. Cl. ..... 585/2; 208/15; 208/19; 44/300; 252/11; 252/43; 585/14

[58] Field of Search ..... 208/15, 19; 252/11, 252/43; 44/300; 585/2, 14

[56] References Cited

U.S. PATENT DOCUMENTS

| | | | |
|---|---|---|---|
| 3,807,976 | 4/1974 | Poiss | 44/62 |
| 4,100,082 | 7/1978 | Clason et al. | 252/33.4 |
| 4,200,545 | 4/1980 | Clason et al. | 252/33.4 |
| 4,663,063 | 5/1987 | Davis | 252/51.5 |
| 4,708,809 | 11/1987 | Davis | 252/33.4 |
| 4,717,489 | 1/1988 | Schieman | 208/19 |
| 4,724,091 | 2/1988 | Davis | 252/33.4 |
| 4,740,321 | 4/1988 | Davis et al. | 252/33.4 |
| 4,873,004 | 10/1989 | Beverwijk et al. | 252/32.5 |
| 5,049,291 | 9/1991 | Miyaji et al. | 252/33 |
| 5,064,546 | 11/1991 | Dasai | 208/19 |

*Primary Examiner*—Asok Pal

*Attorney, Agent, or Firm*—James H. Takemoto

[57] ABSTRACT

Solvent-free lubricant compositions having improved lubricity properties comprising a basestock having a kinematic viscosity of about 1.5 to 3.0 cSt at 100° C., about 3 to 15 wt % of bright stock having a kinematic viscosity about 20 to 40 cSt at 100° C., about 3 to 15 wt % of a polyisobutylene having a number average molecular weight of about 400 to 1050 and about 3 to 15 wt % of a polyisobutylene having a number average molecular weight of about 1150 to 1650. Minor amounts of the lubricant composition may be incorporated into a distillate fuel to provide a lubricant oil-fuel composition for two-cycle engines.

14 Claims, No Drawings

LUBRICATING COMPOSITION FOR TWO-CYCLE INTERNAL COMBUSTION ENGINES

BACKGROUND OF THE INVENTION

1. Field of the Invention

This invention relates to a lubricant composition for use in two-cycle internal combustion engines. More particularly, the lubricant composition is solvent-free while at the same time providing improved lubricating properties.

2. Description of the Related Art

Most two-cycle engines are lubricated by a "once-through" system, where new oil is introduced to the engine internal surfaces for only a brief period of time. As the engine operates, the oil becomes evacuated out the exhaust. However, additional new oil is introduced to the engine at the rate which the used oil is evacuated. In this way, a continual supply of new oil is fed into the two-cycle engine, allowing the fresh oil to lubricate the engine momentarily before being expelled in the exhaust. Since the oil expelled in the exhaust never returns to the engine, this lubrication circuit is called a "once-through" system. Such a system is in marked contrast to the typical lubricant circuit of a four-cycle engine, where the oil remains in the engine for an extended time, and is circulated between the engine internal surfaces and the reservoir many times.

In order to lubricate all internal parts of a two-cycle engine, it is traditional to mix the lubricating oil with the fuel. Such fuel and oil mixing is done at a preferred ratio of between 10 to 250 parts of fuel to one part of oil. The fuel and oil are then mixed with air in a desired ratio of less than about 15 parts of air to one part fuel/oil. The resulting fuel/oil/air mixture is combustible and is introduced to the engine for burning. Since this combustible mixture is exposed to all rolling/sliding interfaces within the engine, the lubricating oil is effectively supplied to all points within the engine where wear is likely to take place. A requirement for such two-cycle engine oils, therefore, is that the oil must mix freely with the fuel, since only if this happens effectively will the lubricating oil be transported to all rubbing surfaces of the engine.

To ensure that the lubricating oil can mix freely with fuel, two-cycle engine oils must have excellent miscibility with gasoline, a property which distinguishes them from most other lubricating oils. To achieve excellent miscibility with gasoline, two-cycle engine oils are traditionally comprised of ~65–75% base oil, ~5–30% solvent, with the remainder comprising an additive package. The incorporation of the solvent in the two-cycle oil provides the necessary fluidity and miscibility for the oil to mix freely with the fuel. The addition of the solvent, however, imparts other less desirable properties to the oil. An example is that the flash point of the lubricating oil is reduced well below 100° C. Therefore, these two-cycle oils present a safety risk, and require special handling to prevent fire.

Once the miscibility of the two-cycle engine oil is at a preferred level, the engine operation will correctly distribute the oil to all critical moving parts within the engine. Having reached the correct internal parts of the engine, however, the oil must then be formulated with special components which provide the oil with lubricity and wear reducing capabilities. Traditionally, there are two ways in which such lubricity/antiwear properties may be blended into the lubricant. The first way is to blend the two-cycle oil with a smaller quantity of a high viscosity additive component such as a high viscosity natural oil fraction or a synthetic polymer. These components effectively increase the viscosity of the oil, thereby imparting improved lubricity/antiwear properties. The second way is to blend the two-cycle oils with a smaller quantity of an antiwear additive. The antiwear additives often contain sulphur or phosphorus, and chemically modify the internal surfaces of the engine to make them more resistant to wear. An example of a two-cycle oil formulation is disclosed in U.S. Pat. No. 4,663,063.

It would be desirable to have a two-cycle oil which is solvent-free while at the same time improving lubricity thereby improving engine performance.

SUMMARY OF THE INVENTION

This invention relates to a solvent-free lubricant composition having improved lubricity properties for use in two-cycle internal combustion engines which comprises:

(a) a major portion of a lubricant oil basestock, said basestock having a kinematic viscosity of about 1.5 to about 3.0 cSt at 100° C.;

(b) from about 3 to about 15 wt. %, based on lubricant composition of a bright stock having a kinematic viscosity of about 20 to about 40 cSt at 100° C.;

(c) from about 3 to about 15 wt. %, based on lubricant composition of a polyisobutylene having a number average molecular weight of from about 400 to about 1050; and (d) from about 3 to about 15 wt. % of a polyisobutylene having a number average molecular weight from about 1150 to about 1650 wherein said lubricant composition is characterized by having a minimum kinematic viscosity of about 4 cSt at 100° C., a maximum kinematic viscosity of about 12 cSt at 100° C. and a flash point greater than about 100° C.

Another embodiment relates to a lubricating oil-fuel composition comprising a major amount of distillate fuel and a minor amount of the lubricant composition set forth above. Yet another embodiment concerns a method for improving lubricating in a two-cycle internal combustion engine which comprises operating the engine with the lubricant oil-fuel composition described above.

DETAILED DESCRIPTION OF THE INVENTION

The lubricating oil basestock used in the lubricant composition of the invention has a lower viscosity than the higher viscosity basestocks typically used in two-cycle oil formulations. The present basestocks have a kinematic viscosity of from about 1.5 to about 3.0 cSt at 100° C. as measured by ASTM D445. Preferred basestocks include solvent extracted napthenic mineral base with a maximum saturates content of less than about 90 wt. %, especially less than about 80 wt. %. The advantages of using the lower viscosity basestock include enhanced fluidity/miscibility, and a reduced need for solvent content.

The bright stock component (b) has a preferred kinematic viscosity of about 25 to about 35 cSt at 100° C. Bright stocks are a well known petroleum fraction obtained, e.g., from the extraction phase of deasphalted vacuum resids.

Polyisobutylenes used as lubricity agents according to the invention are a combination of two different molecular weight polyisobutylenes. The higher molecular weight polyisobutylene provides enhanced lubricity, but may promote more engine deposit formation. The lower molecular weight polyisobutylene provides some lubricity enhancement, while maintaining a low tendency to engine deposit formation. The combination of polyisobutylenes provides a desired balance of excellent lubricity, while maintaining excellent engine cleanliness. One polyisobutylene has a preferred number average molecular weight of about 600–1050 and is present in a preferred amount of from about 3 to about 10 wt. % based on lubricant composition. The second polyisobutylene component has a preferred number average molecular weight of about 1150–1450 and is present in a preferred amount of from about 3 to about 10 wt. % based on lubricant composition. The polyisobutylene components preferably have kinematic viscosities in the range of about 40 to about 1000 cSt at 100° C.

The lubricant compositions are characterized by having a preferred minimum kinematic viscosity of about 6 cSt and a preferred maximum kinematic viscosity of 10 cSt at 100° C. The flash point is preferably greater than 125° C.

If desired, other additives known in the art may be added to the lubricating base oil. Such additives include dispersants, antiwear agents, antioxidants, corrosion inhibitors, detergents, pour point depressants, extreme pressure additives, viscosity index improvers, friction modifiers, and the like. These additives are typically disclosed, for example, in "Lubricant Additives" by C. V. Smalhear and R. Kennedy Smith, 1967, pp. 1–11 and in U.S. Pat. No. 4,105,571, the disclosure of which are incorporated herein by reference.

As is well known to those skilled in the art, two-cycle engine lubricating oils are often added directly to the fuel to form a mixture of oil and fuel which is then introduced into the engine cylinder. Such lubricant-fuel blends generally contain about 250-20 parts fuel per one part oil, typically they contain about 100-30 parts fuel per one part oil. Because of the improved lubricity of the lubricant oils according to the invention, much broader ranges of fuel to oil ratios are possible. The fuel to oil ratio may range from 500:1 to 10:1 preferably 150:1 to 20:1.

The distillate fuels used in two-cycle engines are well known to those skilled in the art and usually contain a major portion of a normally liquid fuel such as hydrocarbonaceous petroleum distillate fuel (e.g., motor gasoline as defined by ASTM Specification D-439-73). Such fuels can also contain non-hydrocarbonaceous materials such as alcohols, ethers, organo-nitro compounds and the like (e.g., methanol, ethanol, diethyl ether, methyl ethyl ether, nitromethane), are also within the scope of this invention as are liquid fuels derived from vegetable or mineral sources such as corn, alfalfa, shale, and coal. Examples of such fuel mixtures are combinations of gasoline and ethanol, diesel fuel and ether, gasoline and nitromethane, etc. Particularly preferred is gasoline, that is, a mixture of hydrocarbons having an ASTM boiling point of 60° at the 10% distillation point to about 205° C. at the 90% distillation point.

Two-cycle fuels may also contain other additives which are well known to those skilled in the art. These can include anti-knock agents such as tetra-alkyl lead compounds, methyl tertiary butyl ether, lead scavengers such as halo-alkanes (e.g., ethylene dichloride and ethylene dibromide), dyes, cetane improvers, anti-oxidants such as 2,6-di-tertiary-butyl-4-methylphenol, rust inhibitors such as alkylated succinic acids and anhydrides, bacteriocides, gum inhibitors, metal deactivators, demulsifiers, upper cylinder lubricants, anti-icing agents, and the like. This invention is useful with lead-free as well as lead containing fuels.

The invention will be further understood by reference to the following Examples, which include a preferred embodiment of the invention.

EXAMPLE 1

Wear Testing

This example compares the effects of basestock viscosity and solvent on wear properties. A wear test is carried out by rubbing metal surfaces together under load and in the presence of the two-cycle oil. Wear of the metal surfaces takes place during the test. When the test is completed, the extent of total wear on the metal surfaces is assessed, and the oil antiwear properties are inferred. The metal surfaces and the manner in which they are rubbed together may be chosen to simulate the events occurring within an operating two-cycle engine.

One such wear test is the Falex pin-on-vee-block test which conforms to test procedure ASTM D-3233. The test rotates a slender cylindrical pin about its long axis under controlled conditions. Two vee-blocks are pressed against the circumference of the pin with a controlled load. The pin and vee-blocks are immersed in the two cycle oil and allowed to run for a specified duration during which the pin wears. When the test is completed, the pin is weighed. The difference in pin weight before and after the test establishes the amount of wear, with lower weight differences indicating better lubricant antiwear properties. It has been found that by running this test at modified conditions of 400 lbs load for 30 minutes duration, the antiwear properties of the two-cycle engine oils may be effectively determined.

Falex pin-on-vee-block testing was conducted on a solvent-free two-cycle oil according to the invention and a solvent containing two-cycle oil. The solvent-free oil contains 65 wt. % basestock having a viscosity of about 2 cSt at 100° C., 5 wt. % bright stock, 10 wt. % of a mixture of polyisobutylenes and the balance an additive package containing a dispersant, corrosion inhibitor, pour point depressant, antioxidant, lubricity additive and antiwear additive. The solvent containing oil is the same as the above oil except that the 65 wt. % 2 cSt viscosity basestock is replaced by 40% of a 30 grade oil having a viscosity of about 11 cSt at 100° C. and 25% of a commercial aliphatic solvent. The results of a comparison between solvent-free vs. solvent containing two-cycle oils is given in Table 1.

TABLE 1

| Oil Tested | Difference in Pin Weight |
|---|---|
| Solvent-free Two-Cycle Engine Oil | 4.2 mg |
| Solvent-Containing Two-Cycle Engine Oil | 5.3 mg |

Falex pin-on-vee-block test results are a direct measure of wear properties. However, such wear results correlate with lubricity, i.e., the greater the wear, the poorer the lubricity of the oil tested. The results shown in Table 1 indicate that the solvent-free oil has improved lubricity properties over the equivalent solvent-containing oil. A more direct measure of lubricity is an actual engine test as described in Example 2.

EXAMPLE 2

Lubricity Testing

A lubricity test can also be carried out by rubbing metal surfaces together under load and in the presence of the two-cycle oil. The lubricity is assessed by measuring the ability of the oil to control friction at the metal rubbing interfaces. A two-cycle engine oil is claimed to have good lubricity if it can maintain a consistent level of friction between the rubbing metal surfaces under adverse lubrication conditions such as elevated temperature, or with a limited supply of lubricating oil. A two-cycle engine oil is claimed to have inadequate lubricity if the level of friction between the rubbing metal surfaces rises more than a significant amount under adverse lubrication conditions.

The lubricity test is accomplished in a fired two-cycle engine according to the following procedure. While holding the engine at a constant temperature, fuel and oil are supplied to the engine in different ratios. The test starts with an oil rich mixture of fuel/oil, and progressively runs with leaner mixtures of fuel/oil. At a critical point, the supply of oil becomes insufficient to control the friction within the engine, and output power decreases. When the output power decreases by a predetermined amount, the fuel to oil ratio is recorded as a lubricity test measurement. The two-cycle engine oil will provide better lubricity if the engine can reach a higher numerical values of fuel to oil ratio (i.e., increasingly oil starved condition) before losing the specified amount of power.

The results of the lubricity test in a fired two-cycle engine with different fuel to oil ratio are shown in Table 2.

TABLE 2

| Oil | Bright Stock | Average 950 mw Polyisobutylene | Average 1300 mw Polyisobutylene | Fuel to Oil Ratio |
|---|---|---|---|---|
| A[1] | yes | no | no | 250:1 |
| B[1] | yes | no | yes | 300:1 |
| C[1] | yes | yes | yes | 500:1 |

[1]All oils contain 65 wt. % basestock having a viscosity of about 2 cSt at 100° C.; 5 wt. % bright stock, and the same additive package as in Example 1. Oil B additionally contains 10 wt. % polyisobutylene, and Oil C contains 5 wt. % each of the respective polyisobutylenes As can be seen from the data in Table 2, the subject combination of polyisobutylenes according to the invention allows the engine to run at much leaner (500:1) fuel to oil ratios as compared to an oil with only one polyisobutylene (300:1) or a commercial solvent free oil (A) having no polyisobutylene (250:1). These results demonstrate the improved lubricity of the present combination of polyisobutylenes.

What is claimed is:

1. A solvent-free lubricant composition having improved lubricity properties for use in two-cycle internal combustion engines which comprises:

(a) a major amount of a lubricant oil basestock, said basestock having a kinematic viscosity of about 1.5 to about 3.0 cSt at 100° C.;

(b) from about 3 to about 15 wt. %, based on lubricant composition of a bright stock having a kinematic viscosity of about 20 to 40 cSt at 100° C.;

(c) from about 3 to about 15 wt. %, based on lubricant composition of a polyisobutylene having a number average molecular weight of from about 400 to about 1050; and (d) from about 3 to about 15 wt. % of a polyisobutylene having a number average molecular weight of from about 1150 to about 1650;

wherein said lubricant is characterized by having a minimum kinematic viscosity of about 4 cSt at 100° C., a maximum kinematic viscosity of about 12 cSt at 100° C. and a flash point greater than about 100° C.

2. The composition of claim 1 wherein the basestock is a solvent extracted naphthenic mineral base with a maximum saturates content of less than about 90 wt. %.

3. The composition of claim 1 wherein the bright stock is a solvent extracted mineral base with a sulfur content less than about 1 wt. %.

4. The composition of claim 1 wherein the polyisobutylene components (c) and (d) have kinematic viscosities in the range of about 40 to about 1000 cSt at 100° C.

5. The composition of claim 1 additionally comprising an antiwear agent, corrosion inhibitor, dispersant, antioxidant, pour point depressant, and lubricity additive.

6. The composition of claim 1 wherein the lubricant is characterized by having a minimum kinematic viscosity of about 6 cSt at 100° C. and a maximum kinematic viscosity of about 10 cSt at 100° C.

7. The composition of claim 1 wherein the lubricant has a flash point greater than about 125° C.

8. A lubricant oil-fuel composition having improved lubricity properties for use in a two-cycle internal combustion engine, said composition comprising:

(A) a major amount of a distillate fuel; and (B) a minor amount of a solvent-free lubricant composition comprising:

(a) a major amount of a lubricant oil basestock, said basestock having a kinematic viscosity of about 1.5 to about 3.0 cSt at 100° C.;

(b) from about 3 to about 15 wt. %, based on lubricant composition of a bright stock having a kinematic viscosity of about 20 to 40 cSt at 100° C.;

(c) from about 3 to about 15 wt. %, based on lubricant composition of a polyisobutylene having a number average molecular weight of from about 400 to about 1050; and (d) from about 3 to about 15 wt. % of a polyisobutylene having a number average molecular weight of from about 1150 to about 1650;

wherein said lubricant is characterized by having a minimum kinematic viscosity of about 4 cSt at 100° C., a maximum kinematic viscosity of about 12 cSt at 100° C. and a flash point greater than about 100° C.

9. The composition of claim 8 wherein the ratio of fuel to oil ranges from 500:1 to 10:1.

10. The composition of claim 8 wherein the basestock is a solvent extracted naphthenic mineral base with a maximum saturates content of less than about 90 wt. %.

11. The composition of claim 8 wherein the bright stock is a solvent extracted mineral base with a sulfur content less than about 1 wt. %.

12. The composition of claim 8 wherein the polyisobutylene components (c) and (d) have kinematic viscosities in the range of about 40 to 1000 cSt at 100° C.

13. The composition of claim 6 additionally comprising an antiwear agent, corrosion inhibitor, dispersant, antioxidant, pour point depressant, and lubricity additive.

14. The composition of claim 8 wherein the ratio of fuel to oil ranges from 150:1 to 20:1.

* * * * *